US005328394A

United States Patent [19]

Onoue et al.

[11] Patent Number: 5,328,394

[45] Date of Patent: Jul. 12, 1994

[54] STEERING SYSTEM FOR MARINE PROPULSION UNIT

[75] Inventors: Akihiro Onoue; Masahiro Matsumoto, both of Hamamatsu, Japan

[73] Assignee: Sanshin Kogyo Kabushiki Kaisha, Hamamatsu, Japan

[21] Appl. No.: 42,123

[22] Filed: Apr. 2, 1993

[30] Foreign Application Priority Data

Apr. 23, 1992 [JP] Japan ..... 4-129391

[51] Int. Cl.[5] ..... B63H 25/02

[52] U.S. Cl. ..... 440/61; 114/150

[58] Field of Search ..... 114/144 R, 144 E, 150; 440/61, 62, 63; 180/132, 136, 137; 91/59, 509, 510; 92/51, 52, 109, 134

[56] References Cited

U.S. PATENT DOCUMENTS 4,419,084 12/1983 Borst ..... 440/63
4,568,292 2/1986 Hall ..... 440/61
4,744,777 5/1988 Ferguson ..... 440/61

FOREIGN PATENT DOCUMENTS 2286494 11/1990 Japan .

*Primary Examiner*—Jesûs D. Sotelo
*Attorney, Agent, or Firm*—Knobbe, Martens, Olson & Bear

[57] ABSTRACT

A hydraulic assisted steering mechanism for marine propulsion drive wherein the hydraulic assist is operated by a control valve having its valve element actuated by a wire actuator that is operated by the steering mechanism. The actuating element that interconnects the wire actuator to the control valve element is supported for movement in a variety of embodiments so as to confine the movement in same direction as the valve element.

28 Claims, 4 Drawing Sheets

STEERING SYSTEM FOR MARINE PROPULSION UNIT

BACKGROUND OF THE INVENTION

This invention relates to a steering system for a marine propulsion unit and more particularly to an improved arrangement for actuating a control valve of a hydraulically assisted marine steering arrangement.

In many forms of marine propulsion systems, the propulsion unit is steered remotely by a steering control positioned in the operator's area of the watercraft. Normally a flexible cable is employed for transmitting the steering control from the steering wheel to the marine outboard drive. Frequently a form of hydraulic power assist is employed for assisting in the steering and this includes a linear type of hydraulic motor which is connected to the outboard drive through its tiller for assisting in the steering. A control valve of a servo system actuates the hydraulic motor in response to steering inputs at the steering wheel. The control valve is frequently operated by means of an element that is connected to a portion of the wire actuator so as to move the control valve control element in response to movement of the wire actuator element. Although these systems are effective, the wire actuator element does not move truly in a linear fashion. In addition, the interconnecting actuator between the wire actuator and the control valve element is normally restrained only where it is connected to the control valve element and the wire actuator element. As a result, the movement of the control valve may not actually track the steering needs.

For example, there may be vibrations occur in the wire actuator and these vibrations can be transmitted to the control valve element even though the vibrations do not occur in the direction of steering movement. As a result, some hunting of the position of the outboard drive may result. In addition, other difficulties can arise because of the types of constructions previously employed.

It is, therefore, a principal object of this invention to provide an improved steering control for a hydraulic steering mechanism for a marine propulsion unit.

It is a further object of this invention to provide an improved arrangement for controlling the steering control valve from a wire actuator element.

It is a still further object of this invention to provide an improved actuating arrangement for actuating a control valve of a hydraulic steering system from a wire actuator element wherein the actuating element is confined so that it can only move in the same direction as the control valve element.

SUMMARY OF THE INVENTION

This invention is adapted to be embodied in a hydraulic steering mechanism for a marine propulsion unit that is supported for steering movement about an axis and which has a steering element. A hydraulic motor is operably connected to the steering element for providing a hydraulic assist for the steering. A remote steering operator is provided for operator actuation and a flexible actuator operably connects the steering operator to the steering element for steering thereof. A hydraulic control valve for selectively applying fluid pressure to the hydraulic motor has a control valve element. Actuating means are operatively connected at one end to the flexible actuator and at another end to the control valve element for operating the control valve element upon the exertion of a force to the flexible actuator. Means are provided for confining the movement of the actuating means to the direction of movement of the control valve element.

DETAILED DESCRIPTION OF THE PREFERRED EMBODIMENTS OF THE INVENTION

Figure 1:
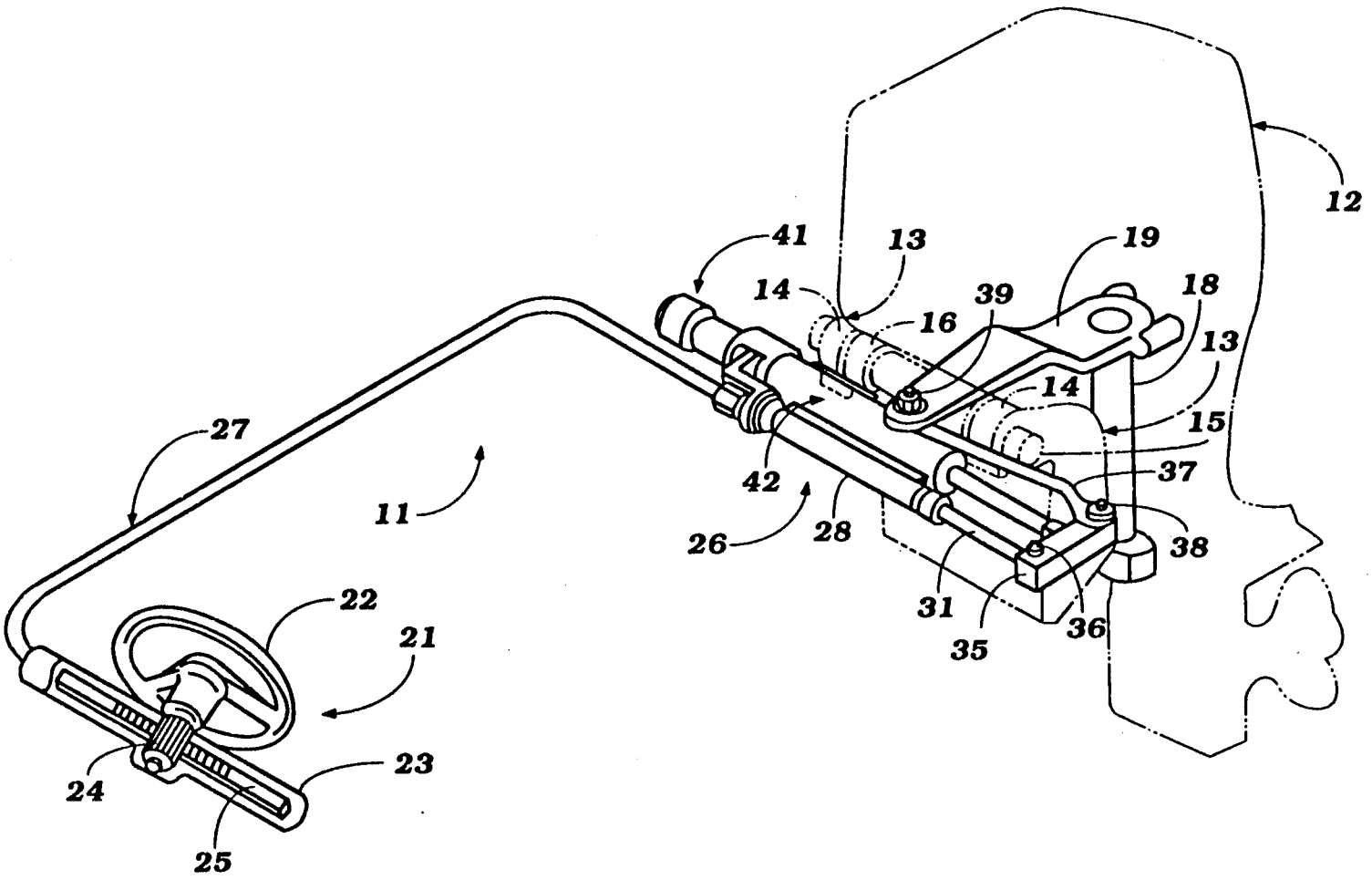
FIG. 1 is a perspective view of a marine propulsion unit steering device constructed in accordance with an embodiment of the invention, with the propulsion device being shown in phantom and a portion of the steering mechanism being broken away.
Figure 2:
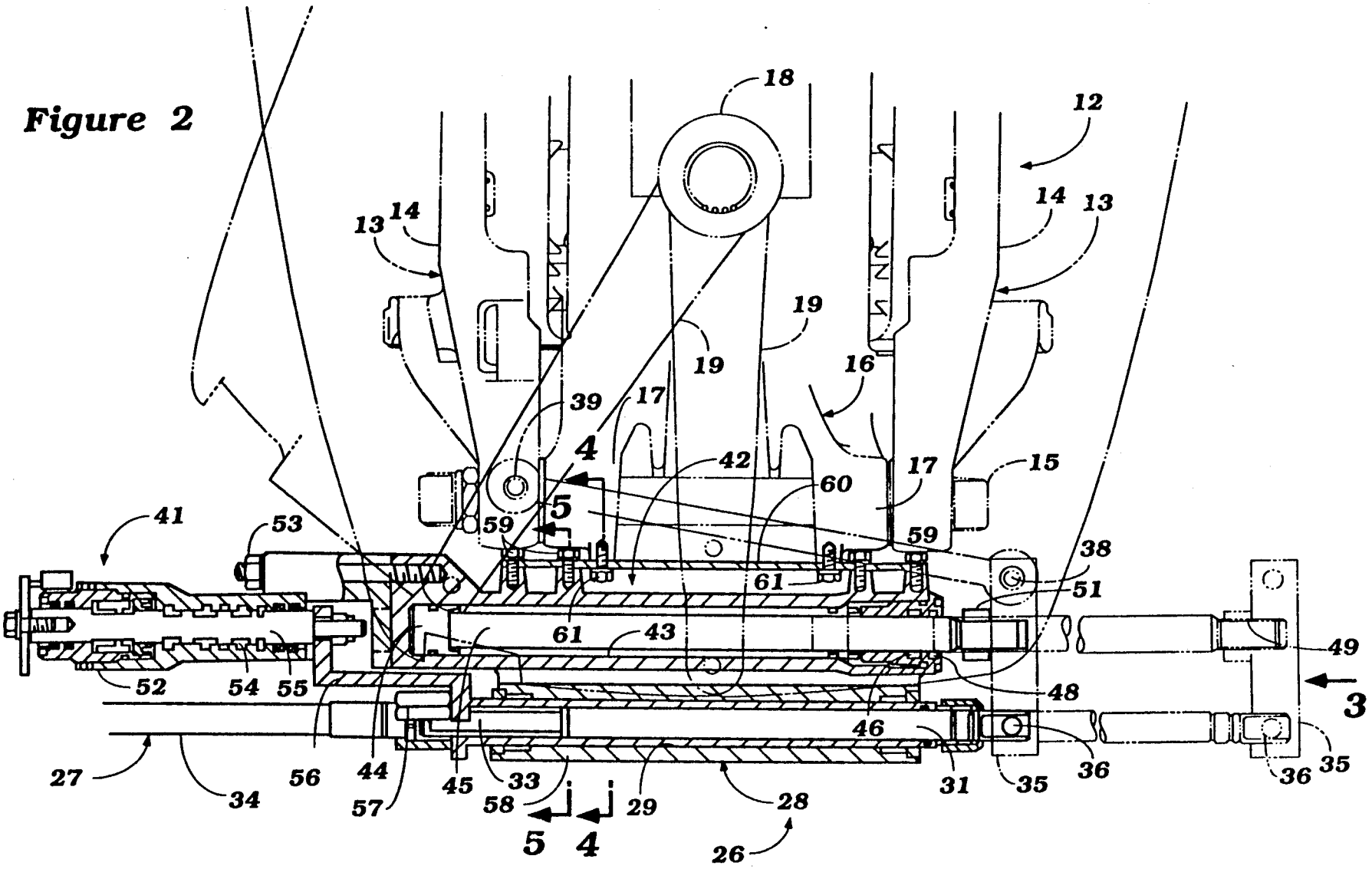
FIG. 2 is an enlarged cross-sectional view taken through the axis of the control cable supporting member and hydraulic piston of the steering mechanism with the marine outboard drive being shown in phantom and illustrated in a straight ahead and fully steered position in one direction.
Figure 3:
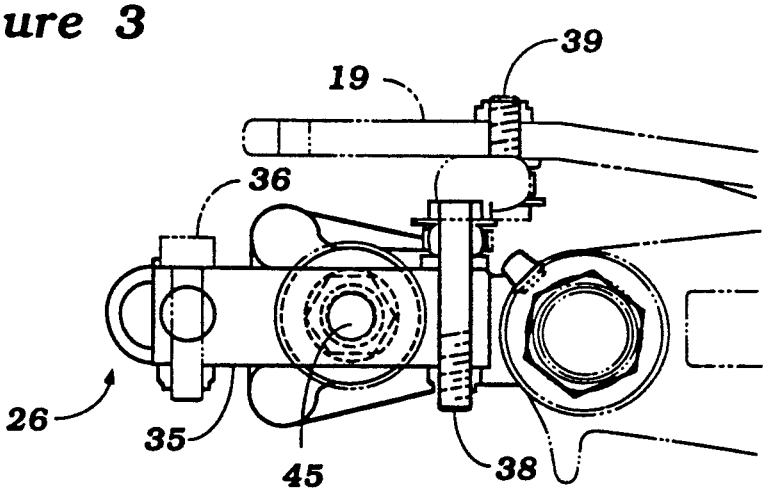
FIG. 3 is an enlarged end elevational view taken in the direction of the arrow 3 in FIG. 2.
Figure 4:
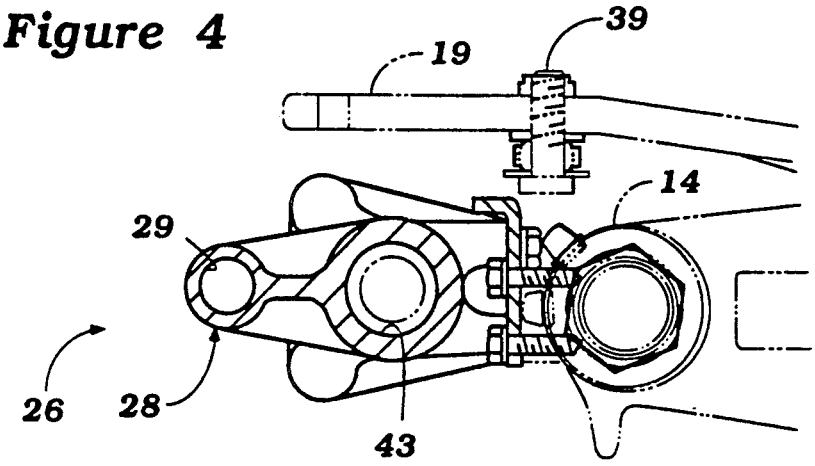
FIG. 4 Is an enlarged cross-sectional view taken along the line 4—4 of FIG. 2.
Figure 5:
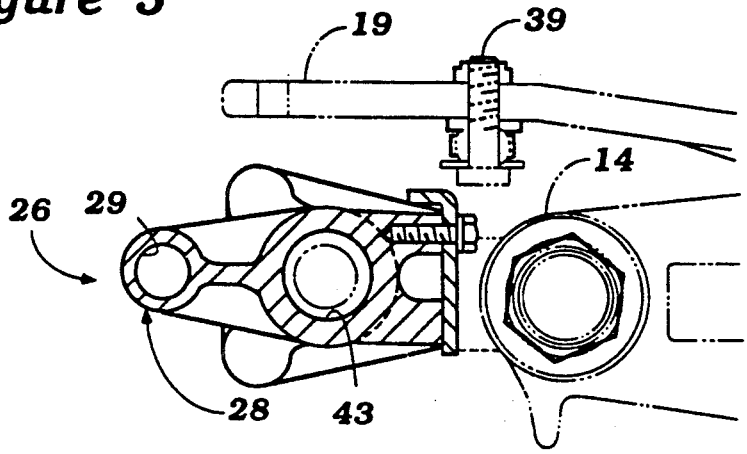
FIG. 5 is an enlarged cross-sectional view taken along the line 5—5 of FIG. 2.

Referring now in detail to the drawings and initially to FIG. 1, a steering device for a marine propulsion unit incorporating the invention is identified generally by the reference numeral 11. In the illustrated embodiment, the steering mechanism 11 is depicted as steering an outboard motor, indicated generally by the reference numeral 12 and shown in phantom. Although the invention is described in conjunction with the steering of an outboard motor, it should be readily apparent that the invention may also be practiced in conjunction with the steering of an outboard drive portion of an inboard/outboard drive and such outboard motors and outboard drives are generically referred to as marine outboard drives. It is to be understood, however, that the invention has particular utility in conjunction with outboard motors since this type of steering mechanism is normally employed with outboard motors.

Although the general construction of the outboard motor is not relevant to the invention, certain components and their relationship is. These components will be described and are comprised of a clamping bracket 13 which has a pair of spaced apart portions 14 and which is affixed in a suitable manner to the transom (not shown) of the associated watercraft. A tilt pivot pin 15 is affixed in trunnion portions of the arms 14. The tilt pivot pin 15 defines a generally horizontally extending tilt axis. The outboard motor 12 is provided with a swivel bracket, indicated generally by the reference numeral 16, which has a pair of spaced apart arm portions 17 that are journaled upon the tilt pivot pin 15.

The swivel bracket 16, in turn, pivotally supports a steering shaft 18 for movement about a generally vertically extending steering axis. The steering shaft 18 is affixed in a known manner to the outboard drive 12 and specifically and normally to the drive shaft housing thereof.

A steering arm or tiller 19 is affixed to the upper end of the steering shaft 18 and extends forwardly and across the transom of the watercraft. The forward end of the steering arm 19 generally passes over the upper end of the tilt pivot pin 15. The foregoing construction may be considered to be conventional in the type of marine outboard drives which are adapted to be steered by the steering mechanism 11, which will now be described in detail.

The steering mechanism 11 includes a remote operator's portion, indicated generally by the reference numeral 21, which is comprised of a steering wheel 22 and mounting bracket 23 which journals the steering wheel 22 for rotary motion about a steering axis. The mounting bracket 23 is adapted to be mounted at any desired location in the watercraft, generally forwardly of the operator's seat. The steering wheel 22 has affixed for rotation with it a pinion gear 24 that is enmeshed with a rack 25 that is slidably supported in the mounting bracket 23 in a well known manner.

A steering operator, indicated generally by the reference numeral 26, is mounted in a manner to be described either on the transom of the watercraft directly or upon the clamping bracket 13. A bowden wire actuator 27 interconnects the rack 25 with the steering operator 26 in a manner which will be now described by particular reference to FIGS. 2–5.

The steering operator 26 is comprised of a housing assembly 28 which may be formed from a suitable lightweight material such as aluminum alloy or the like. Since the steering operator 26 is mounted internally of the watercraft on the forward side of the transom, it need not necessarily be formed from corrosion resistant materials.

The housing assembly 28 defines a first bore 29 that forms a tubular guide member in which a steering rod 31 is supported for reciprocation in a manner to be described. The steering rod 31 is affixed to one end of a wire actuator 33 of the bowden wire assembly 27. The other end of the wire actuator 33 is, as has been previously noted, affixed to the rack 25. A protective sheath 34 encircles the wire actuator 33 as is well known in this art.

The end of the steering rod 31 spaced from the wire actuator 34 is connected to a steering arm 35 by means of a threaded fastener 36. Upon rotation of the steering wheel 22, the rack 25 will reciprocate as will the wire actuator 33, steering rod 31 and steering arm 35 from a neutral position shown in one phantom line view in FIG. 2 to either of two extreme steering positions, one of which is also shown in phantom lines in FIG. 2. A steering link 37 is pivotally connected to the steering arm 35 at one end by a pivot pin 38. The other end of the steering link 37 is connected to the tiller 19 by a further pivot pin 39. The pivot pins 38 and 39 embody spherical connectors so as to accommodate the tilt and trim movement of the outboard motor 12 relative to the fixed steering operator 26.

A hydraulic power assist is also provided for the steering operator 26 and this hydraulic assist includes a control valve, indicated generally by the reference numeral 41, and a reciprocating type of fluid motor, indicated generally by the reference numeral 42. The fluid motor 42 is comprised of a cylinder bore 43 formed integrally within the housing 28 in parallel relationship to the bore 29 that receives the steering rod 31. The bores 29 and 43 are also parallel to, but offset from, the pivot axis defined by the tilt pin 15.

A piston 44 is slidably supported in the cylinder bore 43 and is depicted in solid lines at the extreme steering position to one side. The piston 44 divides the bore 43 into two opposite pressure chambers, which are selectively pressurized or dumped to a return under the control of the valve 41 in a manner which will be described. There is provided a remotely positioned hydraulic pump driven by an electrical motor or the like for supplying fluid pressure to the control valve 41 and fluid motor 42.

The bore 43 is open through one end of the housing 28 and is blind at its opposite end. A piston rod 45 is affixed to the piston 44 and extends through the open end where it is sealed and slidably supported by a closure plug 46 that is fixed to this open end. A gland type seal 57 and 0 ring seal 48 effect hydraulic sealing of the bore 44 while permitting reciprocal motion of the piston 44 and piston rod 45. The piston rod 45 has its outer end threaded and is received in a tapped opening 49 formed in the steering arm 35. A lock nut 51 holds the steering rod 51 to the steering arm 35. Thus, hydraulic pressure exerted on the piston 44 will assist in the steering movement of the outboard motor 12.

The control valve 41 includes a valve housing 52 that is affixed to the housing assembly 28 by means of a plurality of threaded fasteners 53. The housing 52 defines an internal bore 54 in which a valve spool 55 is supported for reciprocation. The valve housing 52 is formed with suitable supply and return passages that receive hydraulic fluid from the aforenoted pump and selectively deliver it to one of the two chambers formed on the opposite sides of the piston 44 and communicate the other side to the return, as is well known in this art. The valve spool 55 is connected by means of an actuator element 56 and fastener assembly 57 to a retainer for the end of the protective sheath 34 adjacent the housing 28.

When the operator turns the steering wheel 22 in one direction or the other, a force will be exerted on the wire actuator 33 so as to move the steering arm 35 in the appropriate direction. This force will create a reaction on the protective sheath 34 which is transmitted into movement of the valve spool 55 by the actuator element 56 and aforedescribed connection. This will then communicate the respective side of the piston 44 with hydraulic pressure and dump the other side so as to provide a power assist. As the power assist takes place, the reaction on the protective sheath 34 will be reduced and the system will operate as a conventional and well known follow-up system.

The construction as thus far described and particularly that of the actuator element 56 may be considered to be the same as the prior art type of construction. As a result of this, it will be seen that the actuator element 56 is only connected to the valve spool 55 and the protective sheath 34 by the fastener 57 and thus, the movement of the actuator element 56 is not confined to be parallel to the movement of the valve spool 55. As is well known, bowden wire actuators 57 may move transversely as the elements deflect and this transverse movement, some of which may be caused by mere vibration of the components, can give rise to false actuation of the valve spool 55.

In accordance with the invention and the specific embodiment of FIGS. 1–5, the actuator element 56 is provided with a tubular cylindrical portion 58 which is received in the bore 29 and which actually extends the full length of this bore. The steering rod 31 is supported within the hollow interior of the tubular portion 58 and thus the actuator element 56 is confined so as to move in the same direction as the valve spool 55. This avoids the problems with the prior art type of constructions.

A mounting plate 60 is affixed to the housing assembly 28 by means of a plurality of threaded fasteners 59. The mounting plate 60 is also affixed to the clamping bracket 13 by threaded fasteners 61 so that the entire unit can be mounted in a fixed position relative to the transom but nevertheless set forwardly of the transom. As a result, the entire operating device 26 and steering mechanism 11 can be assembled independently of the outboard motor 12 and pre-adjusted. The unit then is simply mounted to the clamping bracket in the manner described and thus construction is greatly simplified and the tilt pin 15 need not be designed so as to accommodate the steering rod 31.

Figure 6:
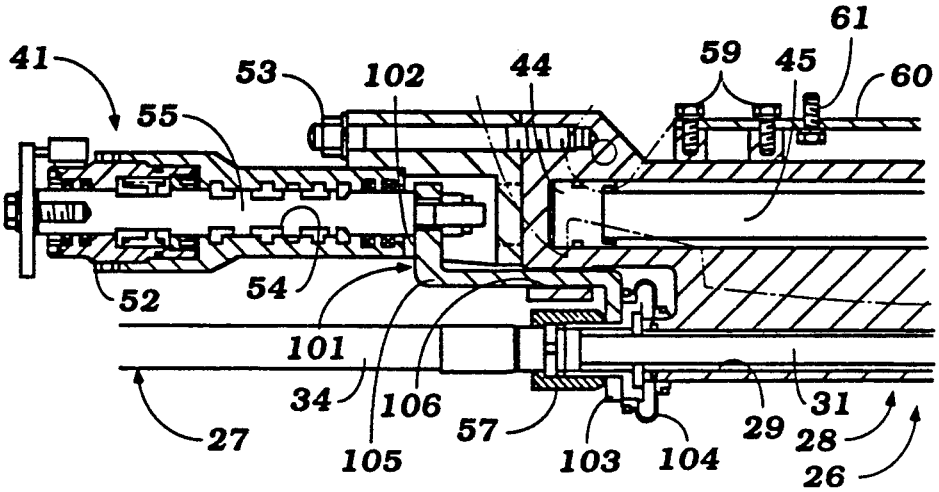
FIG. 6 is a partial enlarged cross-sectional view, in part similar to FIG. 2, and shows another embodiment of the invention.

FIG. 6 illustrates another embodiment of the invention which is generally the same as the embodiment of FIGS. 1–5 and differs from that embodiment only in the manner in which the actuator element that interconnects the control valve spool with the wire actuator protective sheath is supported so that its movement is confined to be parallel to that of the valve spool. For this reason, only this portion of the construction is illustrated and, except as will be hereinafter noted, the construction of this embodiment may be considered to be the same as that previously described.

In this embodiment, the actuator element is indicated generally by the reference numeral 101 and has a first end portion 102 that is affixed to the control valve 53 in the manner previously described. A second end portion 103 is connected to the protective sheath 34 by the fastener 57 in the manner also previously described. In this embodiment, a sealing boot 104 is interposed between the actuator element end portion 103 and the housing assembly 28 to provide a seal around the bore 29 in which the steering rod 31 is slidably supported. An intermediate portion 105 of the actuator element 101 is slidably supported in a complementary opening 106 formed in the housing assembly 28. Hence, this interengagement between the portion 105 of the actuator element 101 and the opening 106 of the housing assembly 28 will confine the movement of the actuator element 101 to be parallel to the valve spool 55 and thus achieve the advantages as aforenoted.

Figure 7:
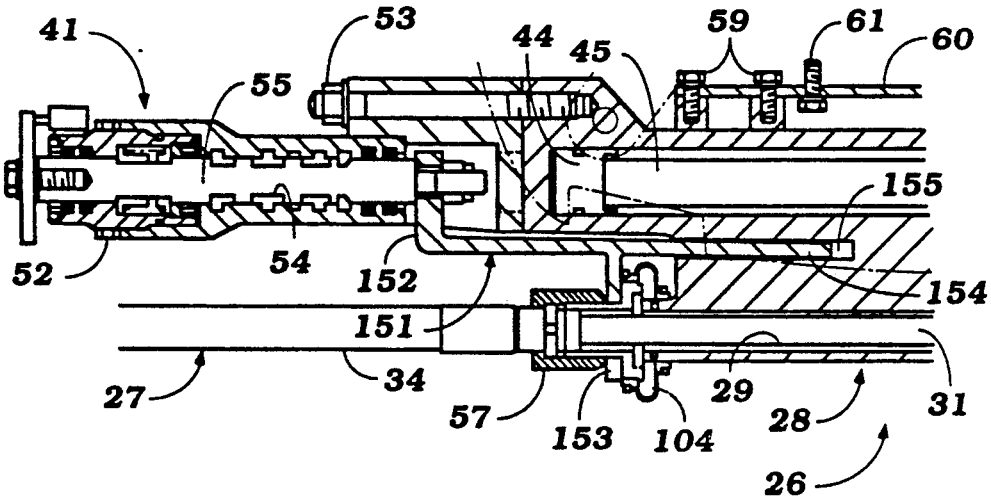
FIG. 7 is a partial enlarged cross-sectional view, in part similar to FIGS. 2 and 6, and shows a third embodiment of the invention.

FIG. 7 shows another embodiment of the invention which differs from the embodiments of FIGS. 1–5 and 6 only in the way in which the actuator element is guided. For that reason, only this portion of the construction has been illustrated and will be described. Where elements are the same as those previously described, they are identified by the same reference numerals and further description of them is believed to be unnecessary.

In this embodiment, the actuator element is identified generally by the reference numeral 151 and has a first end portion 152 that is affixed to the valve spool 55 in the manner previously described. A second portion 153 of the actuator element 151 is affixed to the wire actuator protective sheath 34 by the fastener 57 as previously described. In addition, a sealing boot 104 is interposed between the housing 28 and the actuator element portion 153 for sealing the bore 29 as with the embodiment of FIG. 6.

In this embodiment, the actuator element 151 has an extending guide portion 154 that is received in a complementary opening 155 formed in the housing 28 so as to confine the movement of the actuator element 151 in the same direction as the valve spool 55 and thus achieves the advantages of the previously described embodiments.

It should be readily apparent from the foregoing description that the described embodiments of the invention are extremely effective in providing a very simple connection between the protective sheath and the valve spool of the hydraulic boost and which confines the movement of the interconnecting actuator element to be parallel to that of the valve spool and thus avoid the disadvantages of the prior art. Of course, the foregoing description is that of a preferred embodiment of the invention and various changes and modifications may be made without departing from the spirit and scope of the invention, as defined by the appended claims.

We claim:

1. A hydraulic steering mechanism for a marine propulsion unit supported for steering movement about an axis and having a steering element, a hydraulic motor operably coupled to said steering element for providing a hydraulic assist for said steering, a remote steering operator for operator actuation, a flexible actuator operably connecting said steering operator to said steering element for steering thereof, a hydraulic control valve for selectively applying fluid pressure to said hydraulic motor, said control valve including a control valve element, actuating means operatively connected at one end to said flexible actuator and at another end to said control valve element for operating said control valve element upon the exertion of a force to said flexible actuator, and means for controlling the movement of said actuating means so that said actuating means only move in the direction of movement of said control valve element.

2. A hydraulic steering mechanism as set forth in claim 1 wherein the means for controlling the movement of the actuating means is fixed relative to the hydraulic motor.

3. A hydraulic steering mechanism as set forth in claim 2 wherein the means for controlling the movement of the actuating means is fixed relative to a housing of the control valve in which the control valve element moves.

4. A hydraulic steering mechanism as set forth in claim 3 wherein the means for controlling the movement of the actuating means cooperates with a portion of the actuating means between its ends.

5. A hydraulic steering mechanism as set forth in claim 3 wherein the means for controlling the movement of the actuating means cooperates with an extended end portion of the actuating means.

6. A hydraulic steering mechanism as set forth in claim 5 wherein the extended end portion is tubular.

7. A hydraulic steering mechanism as set forth in claim 5 wherein the extended end portion comprises a projection extending from the end affixed to the flexible actuator.

8. A hydraulic steering mechanism as set forth in claim 1 wherein the flexible actuator comprises a control wire and a protective sheath and wherein the actuating means is connected to an end of the protective sheath.

9. A hydraulic steering mechanism as set forth in claim 8 wherein the means for controlling the movement of the actuating means is fixed relative to the hydraulic motor.

10. A hydraulic steering mechanism as set forth in claim 9 wherein the means for controlling the movement of the actuating means is fixed relative to a housing of the control valve in which the control valve element moves.

11. A hydraulic steering mechanism as set forth in claim 10 wherein the means for controlling the movement of the actuating means cooperates with a portion of the actuating means between its ends.

12. A hydraulic steering mechanism as set forth in claim 10 wherein the means for controlling the movement of the actuating means cooperates with an extended end portion of the actuating means.

13. A hydraulic steering mechanism as set forth in claim 12 wherein the extended end portion is tubular, the wire actuator being connected to an element slidably supported within the tubular member.

14. A hydraulic steering mechanism as set forth in claim 12 wherein the extended end portion comprises a projection extending from the end affixed to the flexible actuator.

15. A hydraulic steering arrangement as set forth in claim 1 wherein the marine propulsion unit is comprised of a clamping bracket adapted to be affixed to the transom of a watercraft, a swivel bracket, tilt pivot means for pivotally supporting said swivel bracket about a generally horizontally extending tilt axis relative to said clamping bracket, a propulsion device carried by said swivel bracket for steering movement about the steering axis, the steering element comprising a steering arm affixed to said propulsion device and extending toward the watercraft transom, the wire actuator comprising a control cable affixed at one end to said steering operator for operation thereby, a guide tube for receiving a member operably connected to the other end of said steering cable and supporting said member for movement along a reciprocal axis spaced from said tilt axis, and means for operating said steering arm from said member for steering of said propulsion device.

16. A hydraulic steering arrangement as set forth in claim 15 wherein the guide tube is affixed relative to the transom of the watercraft independently of the means providing the tilt axis.

17. A hydraulic steering arrangement as set forth in claim 16 wherein the guide tube is affixed to the clamping bracket.

18. A hydraulic steering arrangement as set forth in claim 17 wherein the hydraulic motor comprises a hydraulic cylinder for containing a piston for assisting in the steering.

19. A hydraulic steering arrangement as set forth in claim 18 wherein the axis of the hydraulic cylinder is parallel to the axis of the reciprocal axis of the member and parallel to and offset from the tilt axis.

20. A hydraulic steering arrangement as set forth in claim 19 wherein the hydraulic cylinder is formed as a unit with the guide tube.

21. A hydraulic steering arrangement a set forth in claim 20 wherein the hydraulic control valve includes a valve housing affixed to said guide tube and said hydraulic cylinder for controlling the operation of said hydraulic cylinder.

22. A hydraulic steering arrangement as set forth in claim 21 wherein the valve is substantially coaxial with the hydraulic cylinder.

23. A hydraulic steering arrangement as set forth in claim 22 wherein the axis of the hydraulic cylinder is parallel to the axis of the reciprocal axis of the member and parallel to and offset from the tilt axis.

24. A hydraulic steering arrangement as set forth in claim 23 wherein the hydraulic cylinder, valve means and guide tube are all mounted as a unit.

25. A hydraulic steering mechanism as set forth in claim 24 wherein the means for controlling the movement of the actuating means cooperates with a portion of the actuating means between its ends.

26. A hydraulic steering mechanism as set forth in claim 24 wherein the means for controlling the movement of the actuating means cooperates with an extended end portion of the actuating means.

27. A hydraulic steering mechanism as set forth in claim 26 wherein the extended end portion is tubular.

28. A hydraulic steering mechanism as set forth in claim 27 wherein the extended end portion comprises a projection extending from the end affixed to the flexible actuator.

* * * * *